United States Patent [19]

Zeitler et al.

[11] 3,992,341

[45] Nov. 16, 1976

[54] FILAMENTS AND FIBERS AND THEIR MANUFACTURE

[75] Inventors: Gerhard Zeitler, Hessheim; Heinz Mueller-Tamm, Ludwigshafen, both of Germany

[73] Assignee: BASF Aktiengesellschaft, Ludwigshafen (Rhine), Germany

[22] Filed: Apr. 30, 1975

[21] Appl. No.: 573,164

[30] Foreign Application Priority Data

May 28, 1974 Germany ..... 2425665

[52] U.S. Cl. ..... 260/28.5 AS

[51] Int. Cl.[2] ..... C08L 95/00

[58] Field of Search ..... 260/28.5 A; 264/210 F

[56] References Cited

UNITED STATES PATENTS 3,837,022 9/1974 Moore ..... 260/28.5 A X

*Primary Examiner*—Lewis T. Jacobs

*Attorney, Agent, or Firm*—Johnston, Keil, Thompson & Shurtleff

[57] ABSTRACT

Filaments and fibers based on polypropylene or copolymers thereof having a content of from 10 to 90% by weight of bitumen and a process for their manufacture, in which a mixture based on polypropylene or copolymers thereof and containing from 10 to 90% by weight of bitumen is melt-spun and drawn. The filaments and fibers produced in the manner of the invention are suitable for the production of woven and nonwoven fabrics for insulating purposes and carpet underlays.

1 Claim, No Drawings

FILAMENTS AND FIBERS AND THEIR MANUFACTURE

The present invention relates to filaments and fibers based on polypropylene or copolymers thereof and a process for their manufacture.

Mixtures of polyethylene or copolymers thereof and bitumen are known from Chem. Rundschau 45, p. 849 (1969). Such compositions are used for the production of sheeting or sealing webs. Mixtures of polypropylene and bitumen have not hitherto won any significance, since compositions so modified become increasingly brittle as the amount of bitumen contained therein increases and this causes a marked decrease in the strength of the shaped articles made therefrom.

It is an object of the invention to provide modified filaments and fibers and a process for their manufacture wherein filaments and fibers showing slight shrinkage are obtained. It is a further object of the invention to provide filaments and fibers which may be prepared from cheap starting materials. It is yet another object of the invention to provide filaments and fibers which may be produced at a quicker spinning rate than polypropylene for a given strength of end product.

In accordance with the present invention these and other objects and advantages are achieved by filaments and fibers based on polypropylene or copolymers thereof and having a content of from 10 to 90% by weight of bitumen and a process for their manufacture in which a mixture based on polypropylene or copolymers thereof and having a content of from 10 to 90% by weight of bitumen is melt-spun and simultaneously drawn.

The novel filaments and fibers are noteworthy in that it was not foreseeable that the addition of brittle bitumen to polypropylene would lead to filaments and fibers of adequate strength properties. This is all the more surprising in view of the fact that the unstretched filaments show inadequate mechanical strength and only achieve the desired properties by simultaneous spinning and drawing.

A starting material is polypropylene obtained by any of the well known manufacturing processes. Suitable processes are described, for example, in Kunststoffhandbuch IV, "Polyolefine", by R. Vieweg, and preferably use is made of polypropylene mainly containing isotactic polymer. However, polypropylene is suitable which has an atactic portion (soluble in heptane) of up to 40% by weight. Also suitable are copolymers of propylene, preferably with ethylene or butene-1. In such preferred copolymers, ethylene and butene-1 are present in amounts of from 1 to 10% and preferably from 1 to 5% molar. Preferred polymers have an intrinsic viscosity $[\eta]$ of from 1 to 10 and in particular of from 1 to 8.

The polypropylene or copolymers thereof contain from 10 to 90% by weight of bitumen. Preferably, the content of bitumen is from 20 to 80% and more preferably from 40 to 70%, by weight.

Suitable bitumens are natural bitumen such as so-called natural asphalts, but particularly suitable are commercial bitumens such as straight-run bitumen, high-vacuum bitumen and blown bitumen, tars and pitches of all kinds. Preferred bitumens have a penetration value (according to DIN 1995-U 3) of from 0.1 to 80 and in particular from 1 to 10. In addition, preferred bitumens have a softening point of from 40° to 150° and more particularly from 80° to 120° C (according to DIN 1995-U 4).

The polypropylene or copolymers thereof are blended with bitumen. Mixing is preferably carried out in conventional equipment such as kneaders or extruders having a high shearing action to produce an intimate mixture of the two components. Mixing is usually carried out at temperatures of from 160° to 280° C. It has been found advantageous to use mixtures in which the two ingredients are dispersed in each other, i.e. the minor component is present in a particle size of from 0.01 to 100 $\mu$ and preferably from 0.1 to 10$\mu$.

Other auxiliaries may be added to the mixture during its manufacture, for example stabilizers, e.g. antioxidants, dispersing agents such as polyisobutylene or rubbers and parting agents such as stearic acid or esters thereof.

Filaments or fibers are melt-spun from the mixture thus obtained. Production of filaments or fibers may be carried out directly from the molten mixture or after the mixture has been cooled, comminuted and remelted, for example in an extruder. It is advantageous to use spinning temperatures of from 160° to 280° C and more preferably from 180° to 250° C. It is an important feature that melt spinning is accompanied by a drawing operation. Advantageously, drawing is effected during melt spinning at a ratio of from 1:1.1 to 200 and in particular from 1:30 to 1:60. Advantageously, a second drawing operation is then carried out, in which case the draw ratio is, say, from 1:2 to 1:6. By chopping the resulting continuous filaments it is possible to produce staple fibers of suitable length.

In this way, filaments and fibers may be produced which have deniers ranging from 10 to 50 and in particular from 10 to 40. Such fibers have tensile strengths ranging from 10 to 60 kg/mm$^2$.

In this context it is particularly suprising that the filaments and fibers receive the desired properties only when drawn. Undrawn filaments and fibers produced from said mixture are brittle and would appear to be less suitable for industrial utillization.

The filaments and fibers produced in the manner of the invention are suitable for the production of fabrics such as bases for carpets or for the manufacture of non-woven webs for floor coverings and for insulating purposes. An important feature of the fabrics thus produced is their low degree of shrinkage compared with similar fabrics of polypropylene. Such low shrinkage is particularly significant in the use of the fabrics as carpet underlays and insulating materials for hot water pipes.

The invention is further illustrated with reference to the following Examples, in which the parts are by weight.

EXAMPLE 1

50 parts of bitumen having a penetration of 5 at 25° C and a softening point (ring and ball) of 92° C are mixed, in a kneader at 180° C, with 50 parts of polypropylene containing 18% of portions soluble in heptane and having a molecular weight corresponding to a melt index of 2.0 (MFI 230° C/2.16 kg according to ASTM D 1238-65 I) and a density of 0.896 g/cm$^3$ according to DIN 53,479, and the mixture is then granulated in an extruder. This mixture is then melt-spun through a spinneret at 200° C and a rate of 6 m per minute, the resulting extrudate being wound up at a rate of 300 m per minute.

After further drawing at a ratio of 1:3.5 at room temperature, the fibers weigh 17 deniers and have a strength of 22 kg/mm². In a shrinkage test (10 minutes in boiling water) the change in length is 1%. Pure polypropylene processed in the same manner shows a shrinkage of 18%.

EXAMPLE 2

70 parts of bitumen having a penetration of 4 at 25° C and a softening point of 95° C are mixed with 30 parts of polypropylene having the properties stated in Example 1 for 5 minutes at 180° C, and the mixture is then granulated. This mixture is extruded through a spinneret from the melt at 190° C at a rate of 10 m per minute, the resulting extrudate being wound up at a rate of 600 m per minute. Subsequent drawing at a ratio of 1:4 at room temperature gives fibers weighing 12 deniers and having a tensile strength of 15 kg/mm².

The same material, when not stretched, is completely brittle. Moldings made therefrom or the unstretched extrudates may be broken by hand.

The fibers obtained in the above Examples may be used for the production of non-woven webs in the usual manner, which webs may be employed, for example, as underlays for carpets.

We claim:

1. Drawn filaments and fibers based on polypropylene or copolymers thereof with from 1 to 10% molar of ethylene or butene-1 and having an intrinsic viscosity of from 1 to 10, which contain from 10 to 90% by weight of bitumen having a penetration of from 0.1 to 80 and a softening point of from 40° to 150° C.

* * * * *